US005819725A

United States Patent [19]

Borgeson

[11] Patent Number: 5,819,725

[45] Date of Patent: Oct. 13, 1998

[54] AERODYNAMIC DEVICE FOR INCREASING THE FLICKERING OF A NATURAL GAS FLAME

[75] Inventor: Robert A. Borgeson, Cleveland Heights, Ohio

[73] Assignee: Gas Research Institute, Chicago, Ill.

[21] Appl. No.: 608,243

[22] Filed: Feb. 28, 1996

[51] Int. Cl.[6] ..... F23C 1/18; F23C 11/04

[52] U.S. Cl. ..... 126/512; 126/77; 126/515; 126/112; 126/99 D; 431/125; 431/1

[58] Field of Search ..... 431/1, 352, 125, 431/9, 12; 126/512, 92 R, 92 AC, 354, 523, 531, 515, 517, 518, 112, 77, 85 R, 99 D

[56] References Cited

U.S. PATENT DOCUMENTS

| | | | |
|---|---|---|---|
| 4,061,133 | 12/1977 | Swain . | |
| 4,110,063 | 8/1978 | Mitchell . | |
| 4,136,666 | 1/1979 | Haas | 126/518 |
| 4,153,036 | 5/1979 | Billmeyer et al. | 126/515 |
| 4,216,761 | 8/1980 | Stegmeier | 126/518 |
| 4,266,525 | 5/1981 | Hall | 126/518 |
| 4,374,515 | 2/1983 | Conrad | 126/518 X |
| 4,694,818 | 9/1987 | Bridgwater . | |
| 4,883,043 | 11/1989 | Thow et al. . | |
| 4,971,030 | 11/1990 | Thow et al. | 126/512 |

FOREIGN PATENT DOCUMENTS

| | | |
|---|---|---|
| 0069024 | 1/1983 | European Pat. Off. . |
| 2140154 | 11/1984 | United Kingdom . |
| 2222243 | 2/1990 | United Kingdom . |

*Primary Examiner*—Larry Jones
*Attorney, Agent, or Firm*—Speckman Pauley Petersen & Fejer

[57] ABSTRACT

A process and apparatus for combustion of a gaseous fuel in a fireplace in which a plurality of periodic vortices are created in the airflow pattern of the combustion air prior to its mixing with the gaseous fuel, thereby producing a more natural looking, flickering flame.

2 Claims, 1 Drawing Sheet

AERODYNAMIC DEVICE FOR INCREASING THE FLICKERING OF A NATURAL GAS FLAME

BACKGROUND OF THE INVENTION

1. Field of the Invention

Typically, sealed combustion gas fireplaces have flames that are very static. This is because the airflow patterns are too predictable and controlled. As a result, the static flame is not aesthetically pleasing. This invention relates to an apparatus for increasing the flickering of a natural gas flame, thereby providing a more natural looking flame.

2. Description of Prior Art

Gas log fireplaces have been around for many years. For example, U.S. Pat. No. 4,883,043 teaches a gas-fired artificial log fireplace assembly which visually simulates a fire in a fireplace stacked with horizontally disposed artificial logs.

The elements of a successful gas log fireplace include a natural looking flame, efficient combustion, and heat output. British Patent Application 2,140,154 teaches a simulated solid fuel gas fire which, to improve the efficiency of the fire, includes a guide element adapted to lie between the bed of a pervious material and a body of simulated, refractory solid fuel elements (simulated logs), the guide element having a duct for conveying fuel gas from the bed of pervious material to a distribution opening at the top of the guide element and having a separate duct for providing air to a second distribution opening at the top of the guide element interspersed with the first distribution. The first set of ducts are formed as holes from top to bottom of the guide element while the second set of ducts are formed as holes at the top of the guide element and as passages interconnected therewith and leading to the opening at the back of the guide element. Such configuration is said to improve the efficiency of a simulated solid fuel fire.

U.S. Pat. No. 4,061,133 teaches an apparatus for efficiently heating a room or rooms while providing the aesthetic appearance of a plurality of logs burning in a fireplace. The apparatus includes a plurality of log-shaped members having a hollow center portion with passages through the bottom thereof for permitting air to pass upward through the log-shaped members into the hollowed center portion thereof. The log-shaped members form a plurality of holes extending through the upper portion thereof from the hollowed center. A spiral-shaped tube passes serially through each of the logs which tube conveys a fluid, such as water, through the log-shaped members. A fuel burning member, such as a gas burner, extends through the hollowed portion of each log-shaped member along the longitudinal axis defined by the spiral tubing. The fuel burner generates a flame which simultaneously heats the fluid passing through the spiral-shaped tubing and generates a flame which passes upwardly through the holes to give the appearance that the log-shaped members are burning.

U.S. Pat. No. 4,110,063 teaches a gaseous fuel heating appliance comprising a plurality of refractory bodies simulating solid fuel mounted on top of a distributor for the gaseous fuel. To ensure that at least some of the gaseous fuel burns at a high temperature, at least one duct which leads to the upper side of the gas distributor is provided so that air can be passed along the duct to mix with the gaseous fuel.

U.S. Pat. No. 4,694,818 teaches a fireplace grate for gas-fired fireplaces including a gas burner tube in a layer of sand retained in a trough beneath air conduction tubes arranged transversely to the burner tube. The air transfer tubes are connected to a manifold at the rear of the fireplace grate unit which receives air for transport through the conduits and ejection into a room.

British Patent Application GB 2,222,243 teaches a support for an incombustible element in a fuel-effect gas fire in the form of a ceramic combustion gas conduit having one or more gas discharge orifices therein, or which is porous.

Finally, French Patent 0,069,024 teaches a log element for a gas log fire having a plurality of internal passageways for distribution of a gaseous fuel within the gas log and means for conveying the gaseous fuel to the surface of the log where it is burned.

It is apparent that the airflow pattern produced by the devices taught by the above-mentioned prior art references are generally predictable and controlled. As previously stated, because the airflow patterns are predictable and controlled, the flames resulting from such gas fireplaces are generally very static. And, as previously stated, a static flame is neither aesthetically pleasing nor natural looking.

SUMMARY OF THE INVENTION

Accordingly, it is an object of this invention to provide a process and apparatus for combustion of a gaseous fuel in a sealed combustion gas fireplace which produces non-static flames which are aesthetically pleasing.

It is another object of this invention to provide a process and apparatus for combustion of a gaseous fuel in a sealed combustion gas fireplace which utilizes airflow patterns which are generally unpredictable.

These and other objects of this invention are achieved by a gaseous fuel fireplace system comprising a gaseous fuel burner disposed within a substantially sealed combustion chamber, means for introducing combustion air into the substantially sealed combustion chamber, and means for creating a plurality of periodic vortices in an airflow pattern of the combustion air prior to mixing the combustion air with the gaseous fuel. In accordance with one preferred embodiment of the gaseous fuel fireplace system of this invention, the means for creating said plurality of vortices in the airflow pattern of the combustion air prior to mixing of the combustion air with the gaseous fuel comprises at least one blunt structural element disposed within said combustion chamber within a region of the airflow pattern.

A process for combustion of a gaseous fuel in a fireplace in accordance with this invention comprises introducing the gaseous fuel into a substantially sealed combustion chamber, introducing at least a portion of the combustion air required for complete combustion of the gaseous fuel into the substantially sealed combustion chamber, and flowing the combustion air past at least one blunt object prior to mixing with the gaseous fuel, thereby creating at least one vortex structure within the combustion air.

BRIEF DESCRIPTION OF THE DRAWINGS

These and other features and objects of this invention will be better understood from the following detailed description taken in conjunction with the drawings wherein.

DESCRIPTION OF PREFERRED EMBODIMENTS

Most gas-fueled fireplaces, and in particular sealed combustion, gas-fueled fireplaces all have the same aesthetic defect, namely, their flames have little or no motion in them. This is due to the fact that the airflow in the sealed environment of the sealed combustion fireplaces is generally too regular. In order to reduce the regularity of the flow of said combustion air, it is necessary to provide some means for generating turbulence within the combustion air in the fireplace.

When a fluid flows past a blunt object, such as a cylinder, a regular vortex structure is produced for certain Reynold's numbers. This phenomenon is known as "Karman vortex street shedding". Other aerodynamic shapes, such as wingtips, are also known to generate Karman vortex streets. These Karman vortex streets are a pattern of periodic vortices which occur for certain Reynold's numbers. The classic demonstration of vortex shedding is the streets shed from a cylinder in a cross flow. Photos of such vortex shedding are very common in introductory fluid mechanics text.

We have found that for application to a sealed combustion gas fireplace, the Reynold's number of interest is preferably in the range of $10^2$ to $10^7$. The shedding frequency may then be correlated as $St=\omega L/V=0.21$ where $\omega$ is the shedding frequency, L is the diameter of the cylinder used to produce the vortex structure, and V is the velocity of the fluid flowing past the cylinder.

Figure 1:
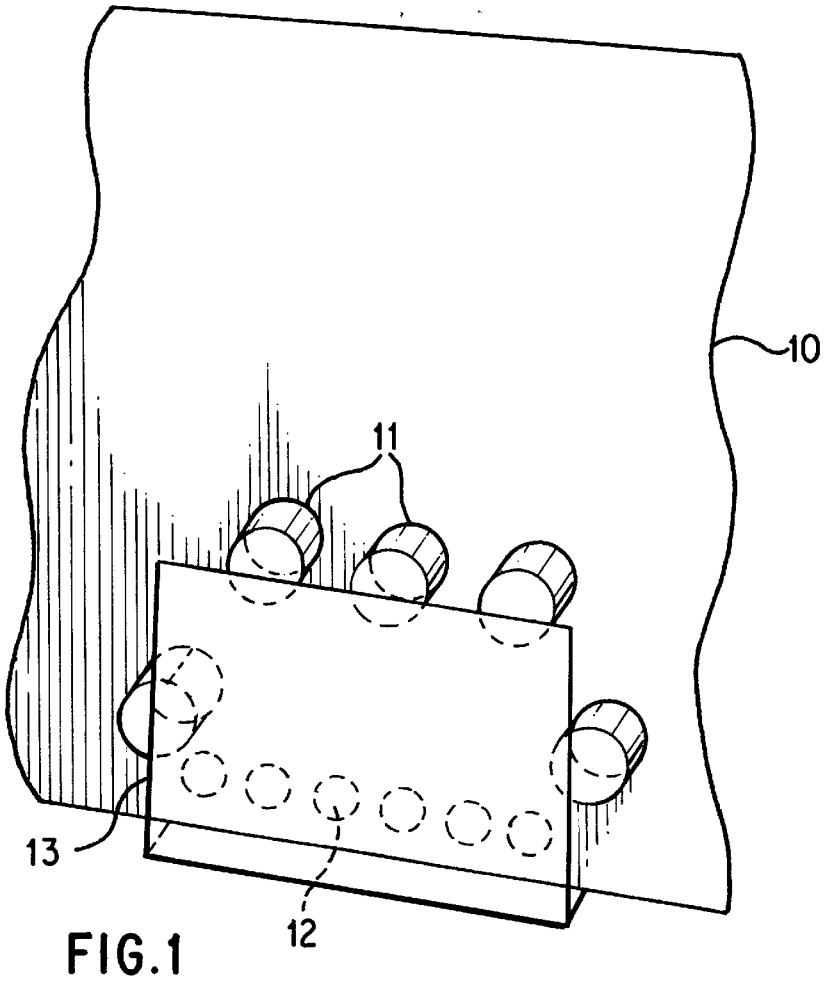
FIG. 1 is a schematic diagram of a vortex generator for a gas-fueled fireplace in accordance with one embodiment of this invention.

We have determined that, for a combustion rate of 20,000 BTU's per hour at 50% excess air, the approximate combustion airflow needed for a sealed combustion gas fireplace will have a Reynold's number equal to about 425 with five 2" diameter cylinders when arranged as shown in FIG. 1. The shedding frequency resulting from this configuration is in the range of 11 to 12 Hz. Vortices shed at around 11–12 Hz are close to the characteristic natural flickering frequency of the flame from a burner typically used in gas fireplaces.

FIG. 1 shows an apparatus for generating vortices in the combustion air of a sealed combustion gas fireplace in accordance with one embodiment of this invention. FIG. 1 shows back wall 10 of the fireplace forming a plurality of combustion air openings 12 proximate the base of back wall 10 through which combustion air for combustion of the fuel is introduced into the fireplace. Baffle 13 is disposed at a distance from back wall 10 within the fireplace whereby the combustion air entering the fireplace through combustion air openings 12 is diverted in an upward and sideways direction. Disposed between baffle 13 and back wall 10 are a plurality of cylindrical elements 11. Cylindrical elements 11 are disposed transverse to the direction of flow of combustion air from combustion air openings 12. As a result, when the combustion air flows past cylindrical elements 11, a regular vortex structure is produced in the region above cylindrical elements 11 in the fireplace. The now turbulent combustion air then mixes with the fuel in the fireplace, producing a more natural looking, flickering flame.

Figure 2:
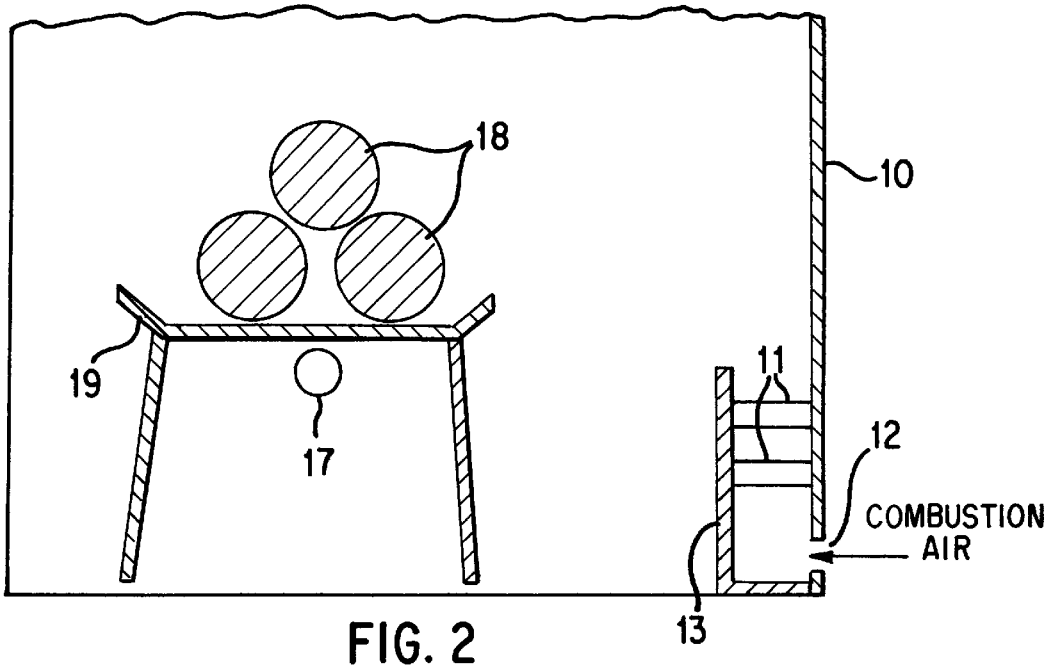
FIG. 2 is a side view of a gas log fireplace employing a vortex generator in accordance with one embodiment of this invention.

FIG. 2 is a side view of a portion of a gas fireplace utilizing a vortex generator in accordance with one embodiment of this invention. Said fireplace system comprises a back wall 10 forming combustion air openings 12, baffle 13 for directing the combustion air entering through combustion air openings 12 in an upward and sideways direction, cylindrical elements 11 disposed between back wall 10 and baffle 13, a fireplace grate 19 supporting a plurality of gas logs 18 disposed in a region towards the front of the fireplace, and gas burner 17 through which gaseous fuel is introduced into the sealed, combustion gas fireplace where it mixes with the combustion air from combustion air openings 12 to produce the desired natural looking, flickering flame.

Although shown as cylindrical structural elements, it will be apparent to those skilled in the art that any blunt structural element disposed within the region of the airflow pattern of the combustion air will produce a plurality of vortices in the airflow pattern. However, cylindrical structural elements having a longitudinal axis disposed transverse to the direction of flow of the airflow pattern are preferred.

The process for combustion of a gaseous fuel in a sealed combustion, gas fireplace in accordance with this invention comprises introducing the gaseous fuel into the combustion chamber, introducing at least a portion of the combustion air required for complete combustion of the gaseous fuel into the combustion chamber, and flowing the combustion air past at least one blunt object prior to mixing with the gaseous fuel, thereby creating at least one vortex structure within the combustion air. The amount of combustion air passing said at least one blunt object is preferably in the range of about 100% to 250% of the total amount of combustion air required for complete combustion of the gaseous fuel. The vortices thus created are shed at frequencies in the range of about 10–15 Hz.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A sealed combustion, gaseous fuel fireplace system comprising:

a gaseous fuel burner disposed within a combustion chamber;

means for introducing combustion air into said combustion chamber; and means for creating a plurality of periodic vortices in an airflow pattern of said combustion air prior to mixing of said combustion air with a gaseous fuel comprising at least one blunt structural element disposed within said combustion chamber within a region of said airflow pattern, said at least one blunt structural element being a cylindrical structural element having a longitudinal axis disposed transverse to a direction of flow of said airflow pattern.

2. A process for combustion of a gaseous fuel in a sealed combustion, gas fireplace comprising:

introducing a gaseous fuel into a substantially sealed combustion chamber;

introducing at least a portion of combustion air required for complete combustion of said gaseous fuel into said substantially sealed combustion chamber said chamber including at least one blunt object disposed in the path of the combustion air; and directing said combustion air to contact said at least one blunt object prior to mixing of said combustion air with said gaseous fuel, creating a plurality of vortices within said combustion air, said vortices being shed at a frequency in a range of about 10 Hz to 15 Hz.

* * * * *